US011225071B2

(12) United States Patent
Tatsuta et al.

(10) Patent No.: US 11,225,071 B2
(45) Date of Patent: Jan. 18, 2022

(54) LIQUID DISCHARGE UNIT AND LIQUID DISCHARGE APPARATUS

(71) Applicant: SEIKO EPSON CORPORATION, Tokyo (JP)

(72) Inventors: Daiki Tatsuta, Matsumoto (JP); Ken Yamagishi, Shiojiri (JP); Masumi Hayakawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/857,639

(22) Filed: Apr. 24, 2020

(65) Prior Publication Data

US 2020/0338885 A1 Oct. 29, 2020

(30) Foreign Application Priority Data

Apr. 26, 2019 (JP) ..... JP2019-085264

(51) Int. Cl.
*B41J 2/175* (2006.01)
*B41J 2/14* (2006.01)

(52) U.S. Cl.
CPC ..... *B41J 2/14* (2013.01); *B41J 2/175* (2013.01); *B41J 2/1752* (2013.01); *B41J 2/17553* (2013.01); *B41J 2202/19* (2013.01)

(58) Field of Classification Search
CPC . B41J 2/14; B41J 2/14024; B41J 2/175; B41J 2/1752; B41J 2/17523; B41J 2/17553; B41J 2002/14362; B41J 2202/19
See application file for complete search history.

(56) References Cited

U.S. PATENT DOCUMENTS 5,825,388 A * 10/1998 Sasaki ..... B41J 2/17553 347/86
6,022,102 A * 2/2000 Ikkatai ..... B41J 2/1652 347/85
6,390,601 B1 * 5/2002 Morita ..... B41J 2/17513 347/49
6,505,923 B1 * 1/2003 Yamamoto ..... B41J 2/17503 347/85
10,759,165 B2 * 9/2020 Iwata ..... B41J 2/04541
2002/0196318 A1 * 12/2002 Shimizu ..... B41J 2/175 347/85
2010/0026759 A1 2/2010 Kobayashi et al.
(Continued)

FOREIGN PATENT DOCUMENTS

JP 2010-030229 2/2010
JP 2017-154488 9/2017

*Primary Examiner* — Anh T Vo
(74) *Attorney, Agent, or Firm* — Workman Nydegger

(57) ABSTRACT

A liquid discharge unit includes a liquid discharge head having a first joint portion and configured to discharge a liquid in a first direction, a liquid supply section having a second joint portion joined to the first joint portion to supply the liquid to the liquid discharge head, and disposed in a second direction opposite to the first direction relative to the liquid discharge head, and a support section which is formed together with the liquid discharge head, and to which the liquid discharge head is fixed. With respect to the first direction, a position at which the liquid supply section is fixed to the support section is located in the second direction with respect to a position at which the first joint portion and the second joint portion are joined to each other.

20 Claims, 5 Drawing Sheets

(56) References Cited

U.S. PATENT DOCUMENTS

2010/0277533 A1* 11/2010 Erdtmann ..... B41J 2/0458
347/14
2017/0232741 A1* 8/2017 Kikuchi ..... H01R 12/77
347/50

* cited by examiner

LIQUID DISCHARGE UNIT AND LIQUID DISCHARGE APPARATUS

The present application is based on, and claims priority from JP Application Serial Number 2019-085264, filed Apr. 26, 2019, the disclosure of which is hereby incorporated by reference herein in its entirety.

BACKGROUND

1. Technical Field

The present disclosure relates to a liquid discharge unit and a liquid discharge apparatus.

2. Related Art

Liquid discharge apparatuses for discharging liquid such as ink from nozzles have been proposed. For example, JP-A-2017-154488 discloses a liquid discharge unit that has a liquid discharge head and flow channel components for supplying a liquid to the liquid discharge head. The flow channel components are joined to the liquid discharge head.

The flow channel components fixed to the liquid discharge head on lower surfaces thereof have certain heights, and when the liquid discharge head is moved with acceleration and deceleration, a relatively large overturning moment acts on the flow channel components. Then, the portions at which the liquid discharge head and the flow channel components are fixed may be damaged or the flow path components may be overturned.

SUMMARY

To solve the above-mentioned problems, a liquid discharge unit according to an aspect of the present disclosure includes a liquid discharge head having a first joint portion and configured to discharge a liquid, a liquid supply section having a second joint portion joined to the first joint portion to supply the liquid to the liquid discharge head, and disposed on one side in a predetermined direction relative to the liquid discharge head, and a support section which is formed together with the liquid discharge head, and to which the liquid discharge head is fixed, in which a position at which the liquid supply section is fixed to the support section in the predetermined direction is farther away on the one side than a position at which the first joint portion and the second joint portion are joined to each other in the predetermined direction.

According to another aspect of the present disclosure, a liquid discharge apparatus includes a liquid discharge head having a first joint portion and configured to discharge a liquid, a liquid supply section having a second joint portion joined to the first joint portion to supply the liquid to the liquid discharge head, and disposed on one side in a predetermined direction relative to the liquid discharge head, a support section which is formed together with the liquid discharge head, and to which the liquid discharge head is fixed, and a moving mechanism configured to move the liquid discharge head, the liquid supply section, and the support section together in a direction different from the predetermined direction, in which a position at which the liquid supply section is fixed to the support section in the predetermined direction is farther away on the one side than a position at which the first joint portion and the second joint portion are joined to each other in the predetermined direction.

DESCRIPTION OF EXEMPLARY EMBODIMENTS

A. First Embodiment

Figure 1:
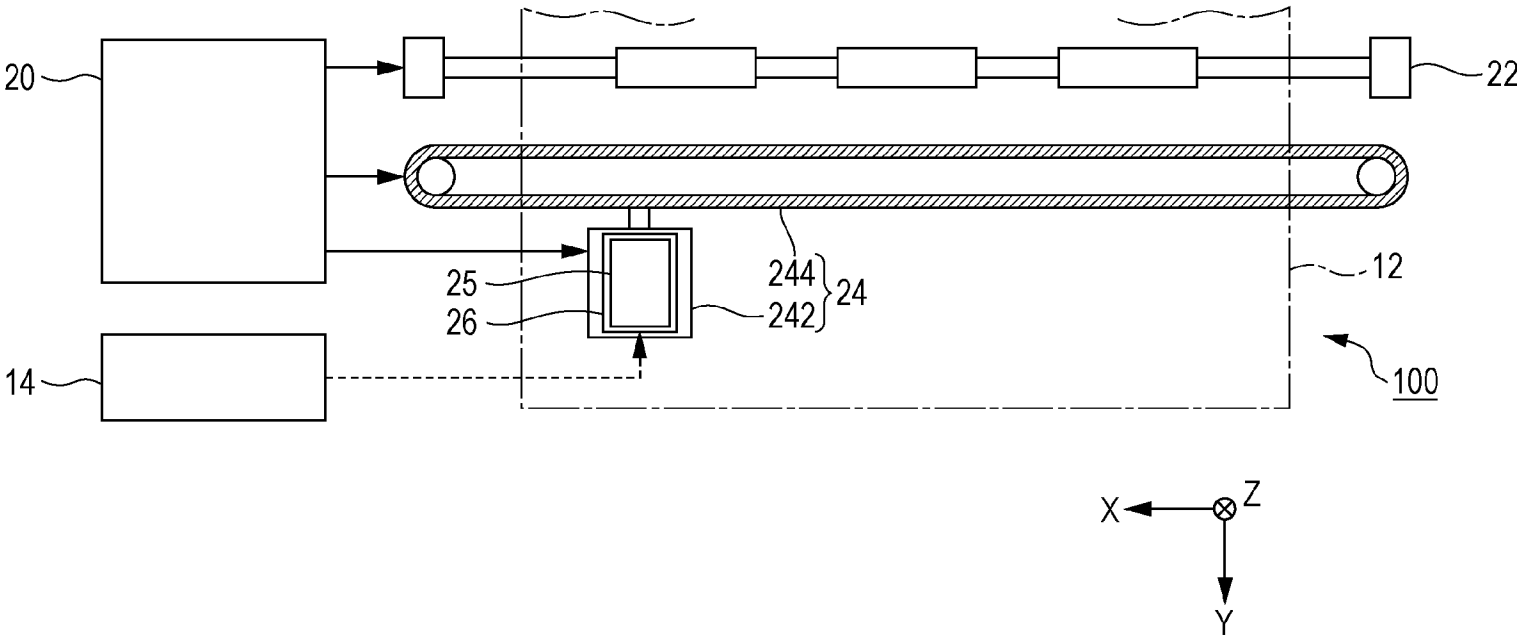
FIG. 1 illustrates a structure of a liquid discharge apparatus according to a first embodiment.

FIG. 1 illustrates an example of a liquid discharge apparatus 100 according to a first embodiment. The liquid discharge apparatus 100 according to the first embodiment is an ink jet recording apparatus that discharges an ink, which is an example of a liquid, onto a medium 12. The medium 12 is typically recording paper. The medium 12 may be a recording target of any material such as a plastic film or cloth. As illustrated in FIG. 1, the liquid discharge apparatus 100 includes a liquid container 14 for storing an ink. The liquid container 14 may be a cartridge that is detachably attached to the liquid discharge apparatus 100, a pouch-shaped ink pack made of a flexible film, or an ink tank that can be refilled with an ink.

As illustrated in FIG. 1, the liquid discharge apparatus 100 includes a control unit 20, a transport mechanism 22, a moving mechanism 24, a liquid supply section 25, and a liquid discharge head 26. The control unit 20 includes, for example, a processing circuit such as a central processing unit (CPU), a field-programmable gate array (FPGA), or the like and a storage circuit such as a semiconductor memory. The control unit 20 performs overall control of components in the liquid discharge apparatus 100. The control unit 20 is an example of a "controller". The transport mechanism 22 transports a medium 12 along a Y axis under the control of the control unit 20.

The moving mechanism 24 reciprocates the liquid supply section 25 and the liquid discharge head 26 along an X axis under the control of the control unit 20. The moving mechanism 24 accelerates immediately after the start of the movement until reaching a constant speed, and decelerates immediately before the stop of the movement until stopping. The X axis intersects the Y axis along which a medium 12 is transported. For example, the X axis and the Y axis are orthogonal to each other. The moving mechanism 24 according to the first embodiment includes a carriage 242 that has a substantially box shape for accommodating the liquid supply section 25 and the liquid discharge head 26, and a transport belt 244 to which the carriage 242 is fixed. A plurality of liquid discharge heads 26 and liquid supply sections 25 may be mounted on the carriage 242, or the liquid container 14 may be mounted on the carriage 242 together with the liquid discharge head 26 and the liquid supply section 25.

The liquid supply section 25 is a structure for supplying an ink from the liquid container 14 to the liquid discharge head 26. The liquid discharge head 26 discharges an ink supplied from the liquid supply section 25 in a positive direction of a Z axis. Specifically, the liquid discharge head 26 discharges an ink supplied from the liquid supply section 25 onto a medium 12 from a plurality of nozzles under the control of the control unit 20. The liquid discharge head 26 discharges an ink onto the medium 12 simultaneously with the transport of the medium 12 by the transport mechanism 22 and the reciprocating motion of the carriage 242, and thereby a desired image is formed on the medium 12. In the description below, an axis perpendicular to an X-Y plane is referred to as the Z axis. A direction along the Z axis is typically the vertical direction (height direction).

Figure 2:
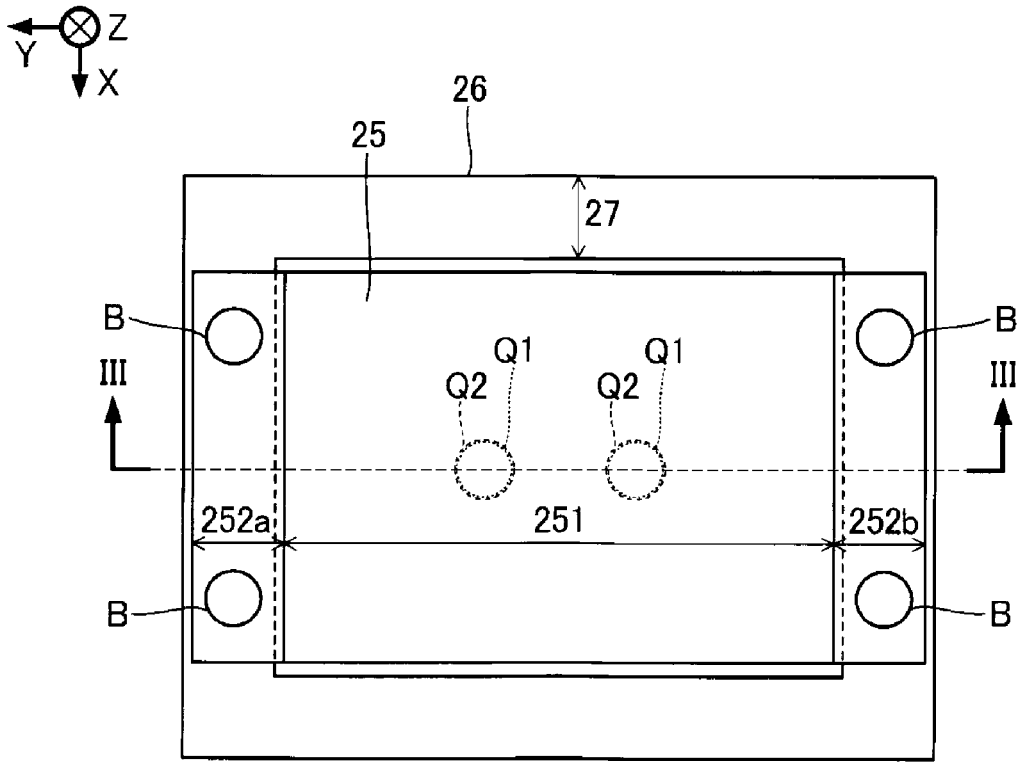
FIG. 2 is a plan view illustrating a liquid discharge head and a liquid supply section.
Figure 3:
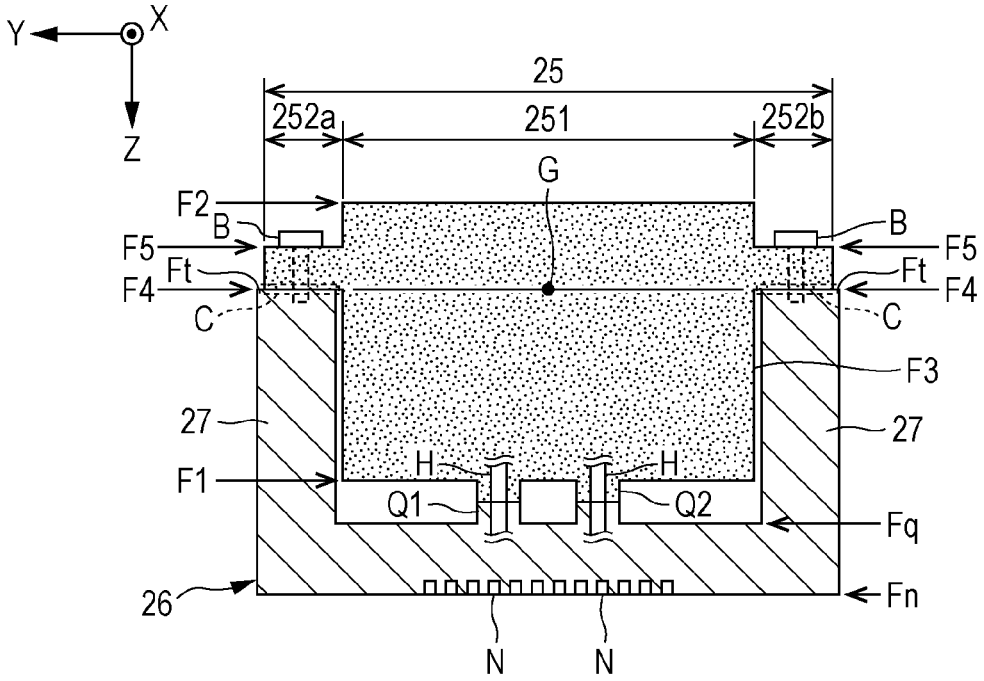
FIG. 3 is a sectional view taken along line III-III in FIG. 2.

FIG. 2 is a plan view illustrating the liquid discharge head 26 and the liquid supply section 25. FIG. 3 is a sectional view taken along line III-III in FIG. 2. The liquid discharge head 26 includes a nozzle surface Fn that has nozzles N and a joint surface Fq that is opposite to the nozzle surface Fn. On the joint surface Fq, the liquid supply section 25 is disposed. The liquid supply section 25 is disposed in a negative direction of the Z axis relative to the liquid discharge head 26. A direction of the Z axis is an example of a "predetermined direction", the negative direction of the Z axis is an example of "one side in the predetermined direction", and a positive direction of the Z axis is an example of "the other side in the predetermined direction".

The liquid supply section 25 has a flow channel H for supplying an ink to the liquid discharge head 26. As illustrated in FIG. 2 and FIG. 3, the liquid supply section 25 includes a flow channel forming section 251, a first joint portion 252*a*, and a second joint portion 252*b*. The flow channel forming section 251 is a part of the liquid supply section 25, and has a flow channel H. Specifically, the flow channel forming section 251 has a first surface F1 that faces the joint surface Fq of the liquid discharge head 26 and a second surface F2 that is opposite to the first surface F1. To facilitate the understanding, in the following description, a second joint portion Q2, which will be described below, extends from the first surface F1 in the positive direction of the Z axis for a relatively long distance; however, actually, an end portion of the second joint portion Q2 in the positive direction of the Z axis extends in the positive direction of the Z axis for only a short distance. Accordingly, in this specification, the first surface F1 is regarded as an end portion of the flow channel forming section 251 or regarded as an end portion of the liquid supply section 25 in the positive direction of the Z axis. Consequently, the first surface F1 may be referred to as a lower end (end portion on the other side in the predetermined direction) of the liquid supply section 25. In view of this, the second surface F2 may be referred to as an upper end (end portion on the one side in the predetermined direction) of the liquid supply section 25.

The first joint portion 252*a* and the second joint portion 252*b* are portions of the liquid supply section 25 on a side surface F3 of the flow channel forming section 251. In the following description, when it is not particularly necessary to distinguish between the first joint portion 252*a* and the second joint portion 252*b*, the joint portions are simply referred to as a "joint portion 252". Specifically, the joint portion 252 extends from the side surface F3 of the flow channel forming section 251 in the Y-axis direction. As illustrated in FIG. 3, a lower surface F4 of the joint portion 252 is farther away than the first surface F1 of the flow channel forming section 251 is in the negative direction of the Z axis, and an upper surface F5 of the joint portion 252 is farther away than the second surface F2 of the flow channel forming section 251 is in the positive direction of the Z axis.

As illustrated in FIG. 2, the first joint portion 252*a* is on the side surface F3 of the flow channel forming section 251 along the Z axis in the positive direction of the Y axis, and the second joint portion 252*b* is on the side surface F3 of the flow channel forming section 251 along the Z axis in the negative direction of the Y axis. Accordingly, the first joint portion 252*a* and the second joint portion 252*b* are disposed on the opposite sides of the flow channel forming section 251 in the Y-axis direction.

In the direction of the X axis, a width of the joint portion 252 is substantially the same as that of the flow channel forming section 251. In the direction of the X axis, the width of the joint portion 252 may be narrower or wider than the width of the flow channel forming section 251. As illustrated in FIG. 3, in the direction of the Z axis, a height of the joint portion 252 is lower than a height of the flow channel forming section 251. In the direction of the Z axis, however, the height of the joint portion 252 may be the same as that of the flow channel forming section 251 or the height of the joint portion 252 may be higher than the height of the flow channel forming section 251.

As illustrated in FIG. 2 and FIG. 3, the liquid discharge head 26 has a first joint portion Q1 and the liquid supply section 25 has the second joint portion Q2. The first joint portion Q1 is a tubular protrusion provided on the joint surface Fq. The second joint portion Q2 is a tubular protrusion provided on the first surface F1 of the flow channel forming section 251. The second joint portion Q2 is joined to the first joint portion Q1 to supply an ink in the flow channel H formed in the flow channel forming section 251 to the first joint portion Q1. The ink in the flow channel H is supplied from the second joint portion Q2 to the first joint portion Q1. The ink supplied to the first joint portion Q1 is discharged from the nozzles N. In the first joint portion Q1 and the second joint portion Q2, a flow channel through which the ink flows is provided. Each of the first joint portion Q1 and the second joint portion Q2 may have any shape. For example, an opening formed on the joint surface Fq may be the first joint portion Q1, or an opening formed on the first surface F1 may be the second joint portion Q2.

As illustrated in FIG. 3, the liquid discharge apparatus 100 has a support section 27 on the joint surface Fq. The support section 27 is a structure used to fix the liquid supply section 25 to the liquid discharge head 26. The support section 27 according to the first embodiment is formed together with the liquid discharge head 26. Specifically, the support section 27 protrudes from the joint surface Fq in the negative direction of the Z axis. As illustrated in FIG. 2, the support section 27 is disposed around the flow channel forming section 251 when viewed from the Z-axis direction in plan view (on an XY plane). In the first embodiment, the circular support section 27 entirely surrounds the flow channel forming section 251. For example, the support section 27 is disposed along the periphery of the joint surface Fq. The side surface F3 of the flow channel forming section 251 faces an inner wall surface of the support section 27.

As illustrated in FIG. 3, the support section 27 is disposed between the liquid discharge head 26 and the joint portion 252 when viewed from the X-axis direction in sectional view (in the direction of the Y axis). In other words, as illustrated in FIG. 2, the joint portion 252 is disposed so as to overlap the support section 27 when viewed from the Z-axis direction in plan view (on the XY plane). As illustrated in FIG. 3, the support section 27 is in contact with the joint portion 252. Specifically, an upper surface Ft of the support section 27 is in contact with the lower surface F4 of the joint portion 252. The support section 27 is in contact with the joint portion 252 at a position away from the joint surface Fq in the negative direction of the Z axis. The liquid supply section 25 is supported by the support section 27 by fixing components B such as screws that are inserted into through holes in the joint portion 252 and the tips of the fixing components are inserted into holes formed in the upper surface Ft of the support section 27. The liquid supply section 25 is fixed to the liquid discharge head 26 via the support section 27 accordingly. In the following description, the position at which the support section 27 is in contact with the joint portion 252 is referred to as a "fixed position C". The fixed position C according to the first embodiment is a position at which the upper surface Ft of the support section 27 is in contact with the lower surface F4 of the joint portion 252. In the first embodiment, the position at which the liquid supply section 25 is fixed to the support section 27 in the Z-axis direction (predetermined direction) is the fixed position C.

The fixed position C is, in the negative direction of the Z axis, closer to the joint surface Fq than the second surface F2 of the flow channel forming section 251 is, and farther away from the joint surface Fq than the first surface F1 of the flow channel forming section 251 is. The lower surface F4 of the joint portion 252 and the upper surface Ft of the support section 27 are disposed, in the negative direction of the Z axis, between the first surface F1 of the flow channel forming section 251 and the second surface F2 of the flow channel forming section 251 accordingly. The fixed position C is set, for example, depending on the center of gravity G of the flow channel forming section 251. The fixed position C according to the first embodiment substantially coincides with the position of the center of gravity G of the flow channel forming section 251 in the negative direction of the Z axis. The joint portion 252 may be disposed, for example, such that in the negative direction of the Z axis, the center of gravity G of the flow channel forming section 251 in the Z-axis direction is located between the lower surface F4 and the upper surface F5 of the joint portion 252. The liquid discharge head 26, the liquid supply section 25, and the support section 27 correspond to a "liquid discharge unit". When the lower surface F1 of the liquid supply section 25 is used as a reference, at each position of the liquid supply section 25 in the Z direction, in a case in which a distance from the reference is x, and the mass is m, a value obtained by $\Sigma(x \times m)/\Sigma(m)$ corresponds to the distance to the center of gravity G from the reference.

Figure 4:
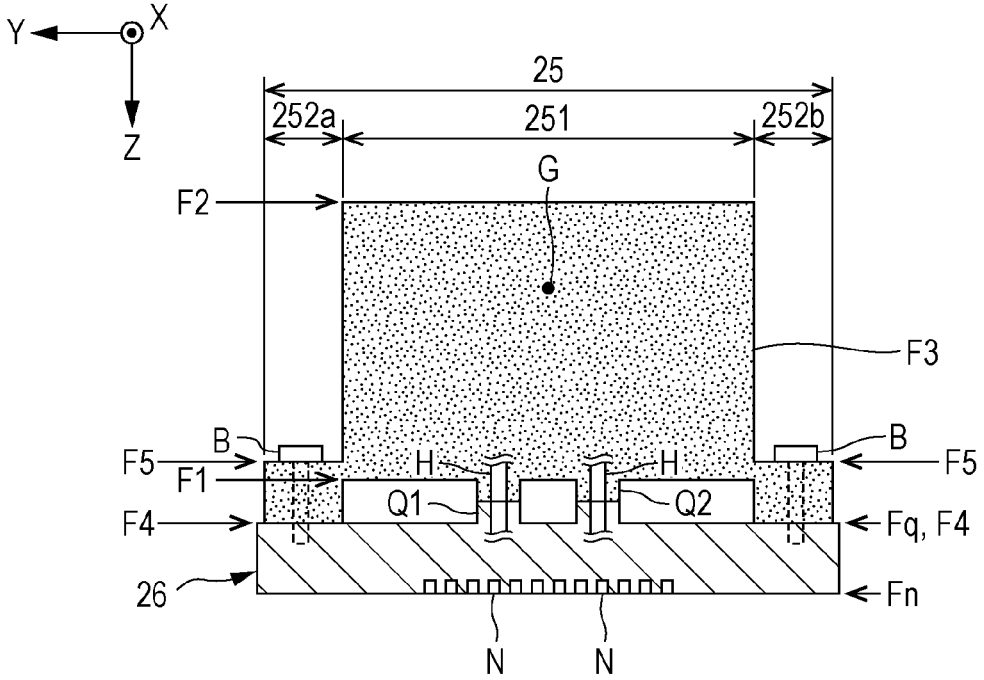
FIG. 4 is a sectional view illustrating a liquid discharge head and a liquid supply section in a comparative example.

FIG. 4 is a sectional view illustrating a structure (hereinafter, referred to as a "comparative example") in which the lower surface F4 of the joint portion 252 is in contact with the joint surface Fq of the liquid discharge head 26. In the comparative example, the support section 27 is omitted, and the joint portion 252 is directly fixed to the liquid discharge head 26. In the comparative example, the position at which the joint portion 252 is in contact with the liquid discharge head 26 is away from the center of gravity G of the flow channel forming section 251, and thus the moment acting on the liquid supply section 25 is large. Accordingly, when the moving mechanism 24 moves the liquid discharge head 26, the joint between the liquid discharge head 26 and the liquid supply section 25 may be damaged. The joint is portions of the liquid discharge head 26 and the joint portion 252 in the vicinity of the fixing components B.

In contrast, in the first embodiment, the joint portion 252 is fixed to the liquid discharge head 26 via the support section 27, and the fixed position C for the support section 27 and the joint portion 252 is farther away relative to the joint surface Fq in the negative direction of the Z axis. In other words, in the Z-axis negative direction, the position of the fixed position C in the Z-axis direction is farther away than the position at which the first joint portion Q1 is in contact with the second joint portion Q2 in the Z-axis direction is. Accordingly, as compared to the comparative example, the fixed position C is close to the center of gravity G of the flow channel forming section 251. With this structure, the joint between the liquid discharge head 26 and the liquid supply section 25 is less damaged due to the moment that acts on the liquid supply section 25.

In the structure according to the first embodiment in which the fixed position C is closer to the joint surface Fq than the second surface F2 of the flow channel forming section 251 is in the negative direction of the Z axis, the fixed position C is closer to the center of gravity G of the flow channel forming section 251 than in the structure in which the fixed position C is farther away from the joint surface Fq than the second surface F2 of the flow channel forming section 251 is. Accordingly, the moment that acts on the liquid supply section 25 can be reduced. As a result, damages to the portions at which the liquid discharge head 26 and the liquid supply section 25 are fixed to each other and the overturn of the liquid supply section 25 can be sufficiently reduced.

Furthermore, in the first embodiment, in a first direction, the fixed position C is farther away from the joint surface Fq than the first surface F1 is. Accordingly, as compared with the structure in which the fixed position C is closer to the joint surface Fq than the first surface F1 is, the fixed position C is close to the center of gravity G of the flow channel forming section 251. As a result, the moment that acts on the liquid supply section 25 can be reduced. With this structure, damages to the portions at which the liquid discharge head 26 and the liquid supply section 25 are fixed to each other and the overturn of the liquid supply section 25 can be sufficiently reduced. In the first embodiment, in particular, the support section 27 is disposed around the flow channel forming section 251 when viewed from the Z-axis direction in plan view (on the XY plane). With this structure, the flow channel forming section 251 is protected by the support section 27.

B. Second Embodiment

Hereinafter, a second embodiment will be described. In the following examples, the reference numerals used in the first embodiment will be used to components that function similarly to those in the first embodiment, and detailed descriptions of the components will be omitted as appropriate.

Figure 5:
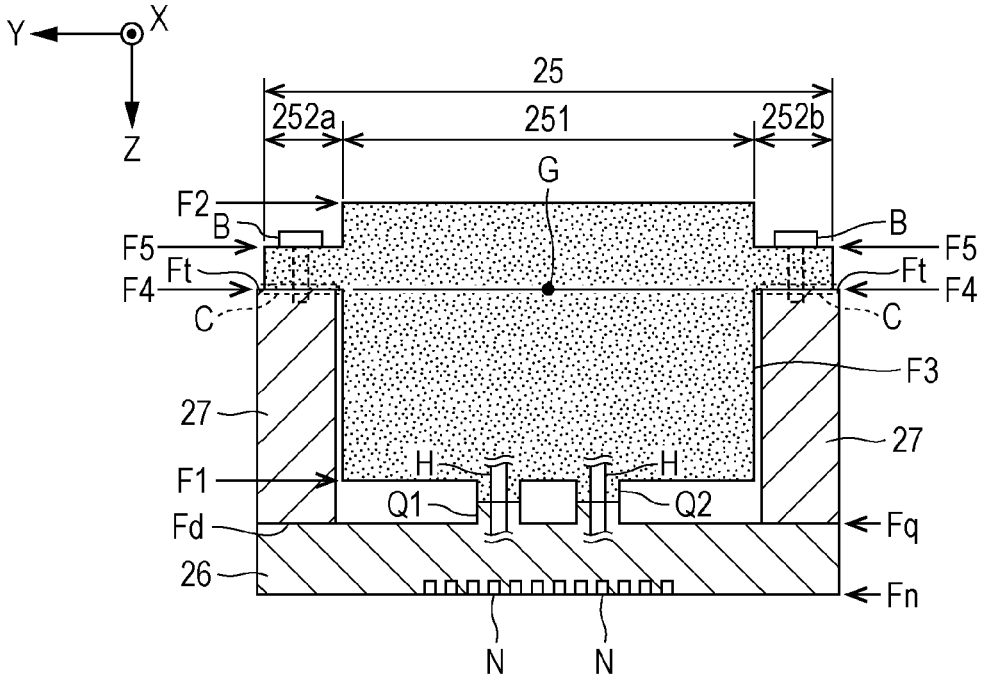
FIG. 5 is a plan view illustrating a liquid discharge head and a liquid supply section according to a second embodiment.

FIG. 5 is a sectional view illustrating a liquid discharge head 26 and a liquid supply section 25 according to the second embodiment. In the first embodiment, the support section 27 is formed together with the liquid discharge head 26. In the second embodiment, the support section 27 is provided separately on the joint surface Fq from the liquid discharge head 26. As illustrated in FIG. 5, a lower surface Fd of the support section 27 that is provided separately from the liquid discharge head 26 is fixed to the joint surface Fq, for example, by using an adhesive. The liquid discharge head 26 and the support section 27 may be fixed to each other by using a fixing element B that is inserted from the nozzle surface Fn of the liquid discharge head 26.

Effects similar to those in the first embodiment can be achieved also in the second embodiment. In the structure according to the first embodiment in which the liquid discharge head 26 and the support section 27 are formed together, it is necessary to provide the liquid discharge head 26 to correspond to the shape of the liquid supply section 25, and it is difficult to join liquid supply sections 25 of various shapes to a common liquid discharge head 26. In other words, the compatibility of the liquid supply section 25 is low. In contrast, in the second embodiment, the support section 27 is provided separately from the liquid discharge head 26. Accordingly, by providing a support section 27 that has a shape corresponding to the shape of the liquid supply section 25, the liquid supply section 25 can be fixed to the liquid discharge head 26. With this structure, the liquid discharge head 26 can be used for the liquid supply sections 25 having various shapes. In other words, the compatibility of the liquid supply section 25 is increased. It should be understood that the structure according to the first embodiment in which the liquid discharge head 26 is formed together with the support section 27 can reduce the number of components in the liquid discharge apparatus 100 as compared to the structure according to the second embodiment in which the support section 27 is provided separately form the liquid discharge head 26.

C. Modifications

The above-described embodiments may be modified in various ways. Specific modifications applicable to the above-described embodiments will be described below. It is to be understood that two or more modifications selected from those below may be combined without a contradiction between them.

1. In the above-described embodiments, the liquid supply section 25 includes the flow channel forming section 251 and the joint portion 252, but the liquid supply section 25 may have any structure. For example, the joint portion 252 may be omitted from the liquid supply section 25, or the flow channel forming section 251 and the joint portion 252 may include different members. As long as the support section 27 is disposed between the liquid discharge head 26 and the liquid supply section 25, and the support section 27 is in contact with the liquid supply section 25 at a position away in the Z-axis negative direction, damages to the portions at which the liquid discharge head 26 and the liquid supply section 25 are fixed to each other and the overturn of the liquid supply section 25 can be reduced. Although the position at which the upper surface Ft of the support section 27 is in contact with the lower surface F4 of the joint portion 252 has been described as an example of a fixed position C in the above-described embodiments, any position at which the support section 27 is in contact with the joint portion 252 may be comprehensively referred to as the fixed position C. The fixed position C may be changed to any position depending on the shapes of the liquid supply section 25 and the support section 27.

Figure 6:
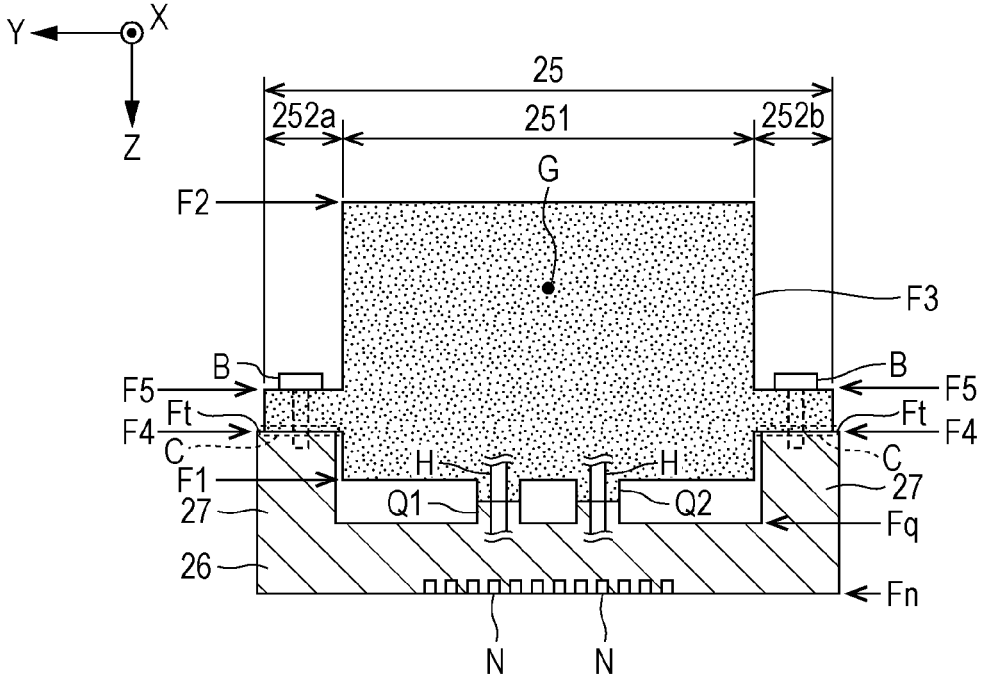
FIG. 6 is a plan view illustrating a liquid discharge head and a liquid supply section according to a modification.

2. In the above-described embodiments, the fixed position C substantially coincides with the center of gravity G of the flow channel forming section 251; however, as illustrated in FIG. 6, the fixed position C may not substantially coincide with the center of gravity G of the flow channel forming section 251. FIG. 6 illustrates a structure in which, in the Z-axis negative direction, the fixed position C is closer to the joint surface Fq than the center of gravity G. The effects of reducing damages to the portions at which the liquid discharge head 26 and the liquid supply section 25 are fixed to each other and the overturn of the liquid supply section 25 can be achieved by any structure in which the fixed position C is farther away than the joint surface Fq is in the Z-axis negative direction. However, the structure in which the fixed position C substantially coincides with the center of gravity G of the flow channel forming section 251 can more sufficiently achieve the effects of reducing damages to the portions at which the liquid discharge head 26 and the liquid supply section 25 are fixed to each other and the overturn of the liquid supply section 25.

Figure 7:
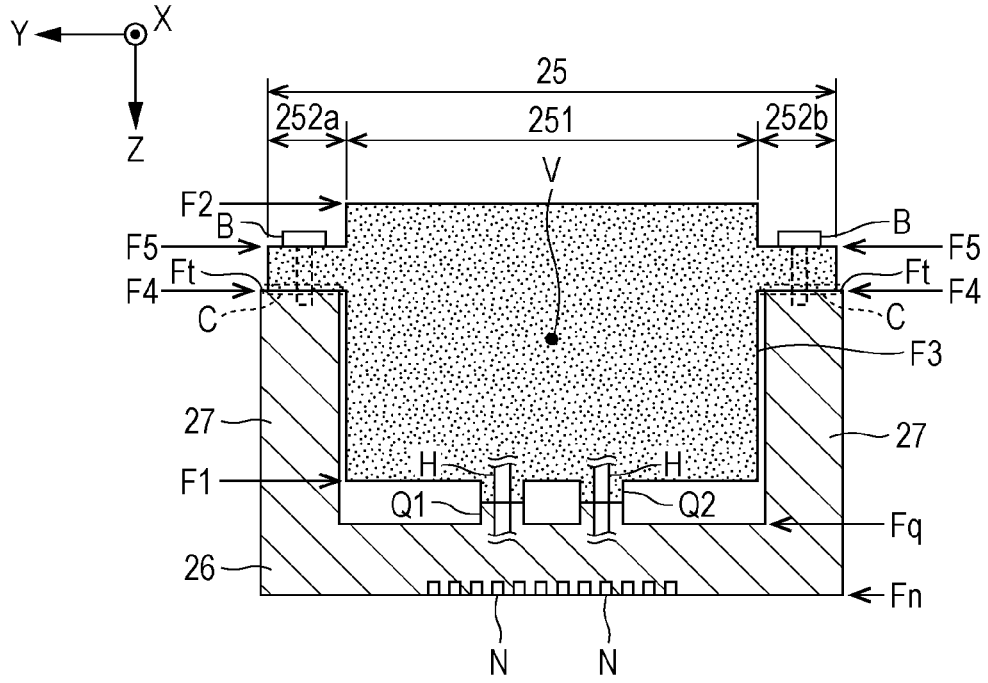
FIG. 7 is a plan view illustrating a liquid discharge head and a liquid supply section according to a modification.

In the above-described embodiments, the fixed position C is set depending on the position of the center of gravity G of the flow channel forming section 251; however, as illustrated in FIG. 7, the fixed position C may be set depending on the position of a midpoint V of the flow channel forming section 251. FIG. 7 illustrates the structure in which the fixed position C is farther away from the joint surface Fq than the midpoint V of the flow channel forming section 251 is in the negative direction of the Z axis is. The midpoint V is a midpoint between the first surface F1 and the second surface F2 in the Z-axis direction. With the above-described structure, the moment that acts on the liquid supply section 25 can be sufficiently reduced.

3. In the above-described embodiments, the circular support section 27 surrounds the flow channel forming section 251; however, for example, the support section 27 may be provided on a part of the entire perimeter of the flow channel forming section 251. For example, the support section 27 may be disposed on a portion overlapping the joint portion 252 when viewed from the Z-axis direction in plan view (on the XY plane).

4. In the above-described embodiments, the joint portion 252 is provided on the side surface of the flow channel forming section 251 in the positive direction and the negative direction of the Y axis. However, the joint portion 252 may be provided at any position on the side surface F3 of the flow channel forming section 251. For example, the joint portion 252 may be provided on the side surface F3 of the flow channel forming section 251 in the positive direction and the negative direction of the Y axis, and on the side surface F3 of the flow channel forming section 251 in the positive direction and the negative direction of the X axis, or on the side surface F3 of the flow channel forming section 251 in the positive direction and the negative direction of the X axis.

5. In the above-described embodiments, the joint portion 252 and the support section 27 are fixed together by using the fixing elements B, but any method can be employed to fix the joint portion 252 and the support section 27 to each other. For example, the joint portion 252 and the support section 27 may be fixed together by using an adhesive.

Figure 8:
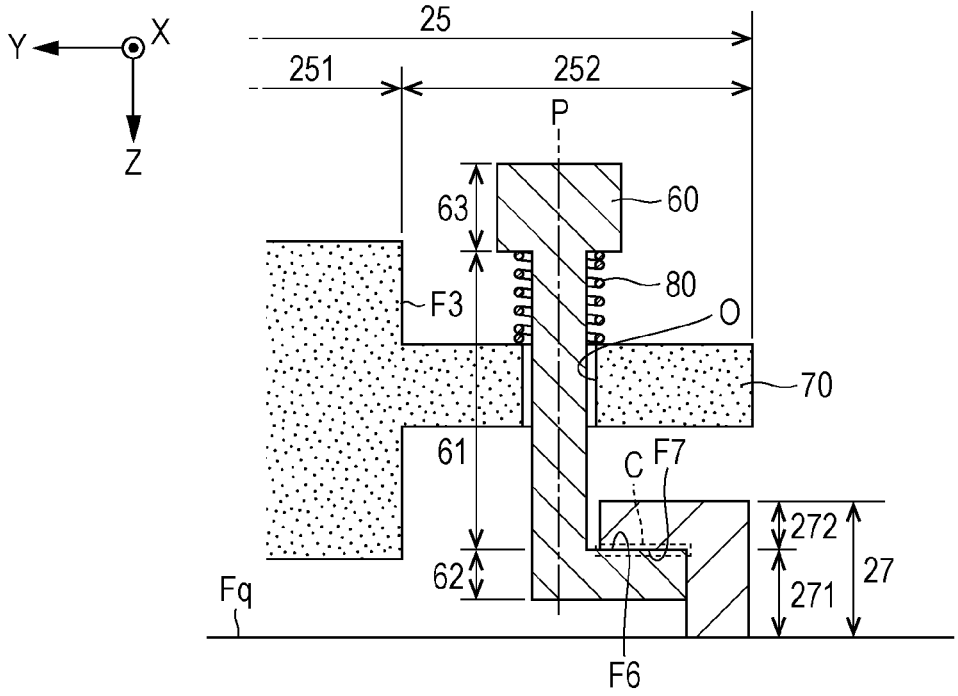
FIG. 8 is a plan view illustrating a liquid discharge head and a liquid supply section according to a modification.

6. The shapes of the joint portion 252 and the support section 27 are not limited to the examples described in the above-described embodiments. FIG. 8 is a sectional view illustrating a joint portion 252 and a support section 27 according to a modification. As illustrated in FIG. 8, the joint portion 252 has an attachment section 60, an extending section 70, and an elastic member 80. The extending section 70 extends from the side surface F3 of the flow channel forming section 251. The attachment section 60 is a structure configured to be engaged with the support section 27. The attachment section 60 has a first portion 61, a second portion 62, and a third portion 63. The first portion 61 is a cylindrical member disposed along the Z-axis direction and is disposed in a through hole O in the extending section 70. The second portion 62 is disposed at an end portion of the first portion 61 on a liquid discharge head 26 side, and the third portion 63 is disposed at the other end portion of the first portion 61. The second portion 62 extends from the first portion 61 in the Y-axis direction. The elastic member 80 is, for example, a coil spring, and is disposed to surround the first portion 61. The elastic member 80 is disposed between the third portion 63 and the extending section 70. The elastic member 80 elastically urges the attachment section 60 in the Z-axis negative direction.

The support section 27 has a first portion 271 and a second portion 272. The first portion 271 is a portion that vertically protrudes from the joint surface Fq in the support section 27. The second portion 272 is a portion that extends from an end portion of the first portion 271 in the Y-axis direction in the support section 27. The joint portion 252 is fixed to the support section 27 by urging the attachment section 60 by using the elastic member 80 in an urging direction in a state in which an upper surface F6 of the second portion 62 is in contact with a lower surface F7 of the second portion 272. In the above-described structure, the position at which the upper surface F6 of the second portion 62 is in contact with the lower surface F7 of the second portion 272 is described as an example of a fixed position C. The fixed position C is away from the joint surface Fq in the Z-axis negative direction. The attachment section 60 can be engaged with the support section 27 by turning the attachment section 60 about a central axis P of the first portion 61 in the X-Y plane.

7. The above-described embodiments describe the serial liquid discharge apparatus 100 in which the liquid discharge head 26 is mounted on the carriage 242 and the carriage 242 is reciprocated. Alternatively, the present disclosure may be applied to a line liquid discharge apparatus in which nozzles N are provided to cover the entire width of a medium 12.

8. The liquid discharge apparatus 100 in the above-described embodiments may be employed in devices dedicated for recording and various devices such as facsimile apparatuses and copying machines. It should be noted that the usage of the liquid discharge apparatus according to any of the embodiments of the present disclosure is not limited to recording. For example, the liquid discharge apparatus that discharges solutions of coloring materials can be used as a manufacturing apparatus for producing color filers for liquid crystal display apparatuses. Furthermore, the liquid discharge apparatus that discharges solutions of a conductive material can be used as a manufacturing apparatus for producing wires and electrodes of wiring boards.

9. In the above-described embodiments, the joint portion 252 is disposed in the liquid supply section 25, and the joint portion 252 is fixed to the support section 27, but the other embodiments may be employed. The joint portion 252 may not be fixed to the support section 27 as long as the liquid supply section 25 can be fixed to the support section 27.

What is claimed is:

1. A liquid discharge unit comprising:

a liquid discharge head configured to discharge a liquid in a first direction, the liquid discharge head having a joint surface and a plurality of first joint portions provided on the joint surface;

a liquid supply section having a plurality of second joint portions, each second joint portion being joined to a respective one of the plurality of first joint portions to supply the liquid to the liquid discharge head, and disposed in a second direction opposite to the first direction with respect to the liquid discharge head; and a support section that is formed integrally with the liquid discharge head, and that the liquid discharge head is fixed to, wherein, with respect to the first direction, a first position at which the liquid supply section is fixed to the support section is located in the second direction with respect to a second position at which the plurality of the first joint portions and the plurality of second joint portions are in contact with each other, the liquid supply section includes a flow channel forming section forming a flow channel through which the liquid flows, and a side surface of the flow channel forming section faces an inner wall surface of the support section and a terminal end surface of the flow channel forming section in the first direction faces the joint surface of the liquid discharge head.

2. A liquid discharge apparatus comprising:

the liquid discharge unit according to claim 1; and a moving mechanism configured to move, with acceleration and deceleration, the liquid discharge head, the liquid supply section, and the support section together in a direction different from the first direction and the second direction, wherein the moving mechanism includes a carriage on which the liquid discharge head and the liquid supply section are mounted.

3. The liquid discharge unit according to claim 1, wherein the support section protrudes from the joint surface from which the plurality of first joint portions extend.

4. The liquid discharge unit according to claim 1, wherein the support section entirely surrounds the flow channel forming section when viewed in the first direction.

5. The liquid discharge unit according to claim 1, wherein the first direction is a vertical direction.

6. The liquid discharge unit according to claim 1, wherein the liquid supply section includes a first joint section provided on the side surface of the flow channel forming section and a second joint section provided on another side surface of the flow channel forming section, the first joint section and the second joint section overlap the support section when viewed in the second direction in plan view, and the first joint section and the second joint section of the liquid supply section are fixed to the support section by a first screw and a second screw.

7. The liquid discharge unit according to claim 1, wherein the plurality of second joint portions is provided on the terminal end surface of the flow channel forming section.

8. The liquid discharge unit according to claim 1, wherein the first joint portion includes an opening, the second joint portion includes an opening, and the second position is at a boundary between the opening of the first joint portion and the opening of the second joint portion.

9. The liquid discharge unit according to claim 1, wherein the liquid supply section and the support section are fixed to each other by a fixing element.

10. A liquid discharge unit comprising:

a liquid discharge head configured to discharge a liquid in a first direction, the liquid discharge head having a joint surface and a first joint portion provided on the joint surface;

a liquid supply section having a second joint portion joined to the first joint portion to supply the liquid to the liquid discharge head, the liquid supply section being disposed in a second direction opposite to the first direction with respect to the liquid discharge head; and a support section that is formed integrally with the liquid discharge head, and that the liquid discharge head is fixed to, wherein, with respect to the first direction, a first position and a third position at which the liquid supply section is fixed to the support section in a state that the first joint portion and the second joint portion are joined to each other are located in the second direction with respect to a second position at which the first joint portion and the second joint portion are in contact with each other, the liquid supply section includes a flow channel forming section forming a flow channel through which the liquid flows with respect to the first direction, the first position and the third position are located in the second direction with respect to a midpoint of the flow channel forming section in the first direction, and a side surface of the flow channel forming section faces an inner wall surface of the support section and a terminal end surface of the flow channel forming section in the first direction faces the joint surface of the liquid discharge head.

11. The liquid discharge unit according to claim 10, wherein the liquid supply section includes a first joint section provided on the side surface of the flow channel forming section and a second joint section provided on another side surface of the flow channel forming section, the first joint section and the second joint section overlap the support section when viewed in the second direction in plan view, and the first joint section and the second joint section of the liquid supply section are fixed to the support section by a first screw and a second screw.

12. The liquid discharge unit according to claim 11, wherein the flow channel forming section is located between the first joint section and the second joint section of the liquid supply section in a third direction different from the first direction and the second direction.

13. A liquid discharge apparatus comprising:

the liquid discharge unit according to claim 12; and a moving mechanism configured to move, with acceleration and deceleration, the liquid discharge head, the liquid supply section, and the support section together in a fourth direction different from the first direction and the second direction, wherein the third direction is orthogonal to the fourth direction.

14. The liquid discharge unit according to claim 11, wherein the first screw is inserted into a through hole of the first joint section and a hole of upper surface of the support section, and the second screw is inserted into a through hole of the second joint section and the other hole of the support section.

15. A liquid discharge apparatus comprising:

the liquid discharge unit according to claim 10; and a moving mechanism configured to move, with acceleration and deceleration, the liquid discharge head, the liquid supply section, and the support section together in a direction different from the first direction and the second direction, wherein the moving mechanism includes a carriage on which the liquid discharge head and the liquid supply section are mounted.

16. The liquid discharge unit according to claim 10, wherein the support section protrudes from the joint surface from which the first joint portion extends.

17. The liquid discharge unit according to claim 10, wherein the support section entirely surrounds the flow channel forming section when viewed in the first direction.

18. The liquid discharge unit according to claim 10, wherein the first direction is a vertical direction.

19. The liquid discharge unit according to claim 10, wherein the second joint portion is provided on the terminal end surface of the flow channel forming section.

20. The liquid discharge unit according to claim 10, wherein the liquid supply section and the support section are fixed to each other by a fixing element.

* * * * *